United States Patent [19]

Clausen et al.

[11] 4,238,097

[45] Dec. 9, 1980

[54] CONDUCTOR'S CHAIR

[75] Inventors: Herman A. Clausen; David R. Boeddeker, both of Owatonna; Logan W. Johnson, Edina; Jerry A. Wenger, Owatonna, all of Minn.

[73] Assignee: Wenger Corporation, Owatonna, Minn.

[21] Appl. No.: 878,732

[22] Filed: Feb. 17, 1978

[51] Int. Cl.[3] ..... A47B 91/00; A47C 1/02; A47C 7/50

[52] U.S. Cl. ..... 248/188.7; 297/423; 297/345

[58] Field of Search ..... 248/188.7, 188; 297/216, 423, 345

[56] References Cited

U.S. PATENT DOCUMENTS

| | | | |
|---|---|---|---|
| 2,909,212 | 10/1959 | Scherer | 297/345 X |
| 3,233,517 | 2/1966 | Morrison | 248/188.7 |
| 3,245,720 | 4/1966 | Wenger | 248/188.7 X |
| 3,285,555 | 11/1966 | Bevington | 297/345 X |
| 3,538,906 | 11/1970 | Heraty et al. | 248/188 X |
| 3,960,406 | 6/1976 | Buker | 297/345 |

FOREIGN PATENT DOCUMENTS

| | | | |
|---|---|---|---|
| 590015 | 3/1925 | France | 297/345 |
| 1361531 | 1/1974 | United Kingdom | 297/345 |

*Primary Examiner*—James T. McCall

*Attorney, Agent, or Firm*—Wegner, Stellman, McCord, Wiles & Wood

[57] ABSTRACT

A conductor's chair, podium and stand wherein a podium has a flat standing area at a relatively low level and both the chair and stand have a plurality of generally horizontally-extending legs with certain of the legs having a greater length to underlie and balance the off-center weight of the chair and stand, respectively, and with the longer legs being positionable under the podium to bring the chair and stand relatively close together and with minimal leg exposure beyond the perimeter of the podium. The chair and stand are of separable parts with interengaging sections which may be assembled in only one relation to assure stability in use.

1 Claim, 6 Drawing Figures

62
61
60
51
101
100
116
121
4.
120
110
102
72
70
71
115
50
88
90
80
5.
85
52
56
54
86
87
81
105
55
53

CONDUCTOR'S CHAIR

BACKGROUND OF THE INVENTION

This invention pertains to a combination of a podium, a stand, and a chair for use by a music conductor or other person and to new and improved structural relations between the components as well as improved frame structure of the chair and stand enabling shipment of separable parts in compact relation and assembly in only a single predetermined manner whereby off-center weight of the stand and chair are balanced by particularly arranged leg structure providing stability.

In conducting choral or orchestral groups, it is well known to have a podium upon which the conductor may stand in order to be visible by the entire group and to have a music stand positionable adjacent the podium. During a rehearsal, the conductor may draw a chair up to the podium to be seated a portion of the time. Additionally, it is known in the art to have a podium chair, such as shown in U.S. Pat. No. 3,245,720 issued to Jerry A. Wenger on Apr. 12, 1966 in which legs of different lengths support a vertically-extending column having a seat generally coaxial with the column and with there being a podium built into the chair structure whereby the conductor may either be in a seated position or stand on the podium section of the podium chair.

SUMMARY OF THE INVENTION

A primary feature of the invention disclosed herein relates to a combination of structure usable by a music conductor or other person having similar requirements including a podium, a stand and a chair providing a group of three units usable in combination or individually and with the structural features of each contributing to the over-all combination as well as providing improved features for the individual units including structure which may be shipped in separable parts and related for assembly in only one predetermined arrangement to assure stable structure.

In carrying out the foregoing, the podium has a flat standing area at a relatively low level with both the stand and the chair having a base with generally horizontal legs extending therefrom. A stand column extends upwardly from a position intermediate the legs and has a work surface extending rearwardly from said column. The chair has a chair column extending upwardly, with a seat extended forwardly from said column. The legs of each of the chair and stand are of different lengths, with at least a pair of legs of the stand being longer than the remaining stand legs and extending rearwardly to balance the stand and be positionable beneath the flat standing area of the podium. A pair of legs of the chair are longer than the remaining chair legs and extend forwardly for positioning beneath the podium and for stabilizing the chair with the forwardly offset seat.

An object of the invention is to provide both a stand and a chair usable independently as well as part of a combination having the aforesaid structure wherein the components of the frame of either the chair or stand may be shipped in separable parts and assembled for use with interacting means between the base and the column whereby the parts may only be assembled in one relation to assure that the longer legs underlie the offset work surface of the stand or the offset chair seat of the chair.

A further object of the invention is to provide a chair usable by conductors or other persons having the aforesaid structure and having substantial height adjustment because of the column structure including a hollow post secured to a base and with a tubular member disposed within the hollow post and being extendable between a lower position substantially entirely within the hollow post and a fully-extended position having only the lower end thereof within the hollow post and with structure associated between the column components for firmly securing the tubular member in adjusted position relative to the hollow post.

An additional object of the invention is to provide interengaging means between a base and column of the frame structure for the music stand or chair whereby the column may be positioned in only a single rotative position within the base and have its movement for insertion therein limited by means of structure which additionally provides added strength in securing the column to the base and with there being similar interengaging means between components of the column of the frame structure to have an upper tubular member thereof only positionable in a hollow post of the column in one rotative position.

DESCRIPTION OF THE PREFERRED EMBODIMENT

Figure 1:
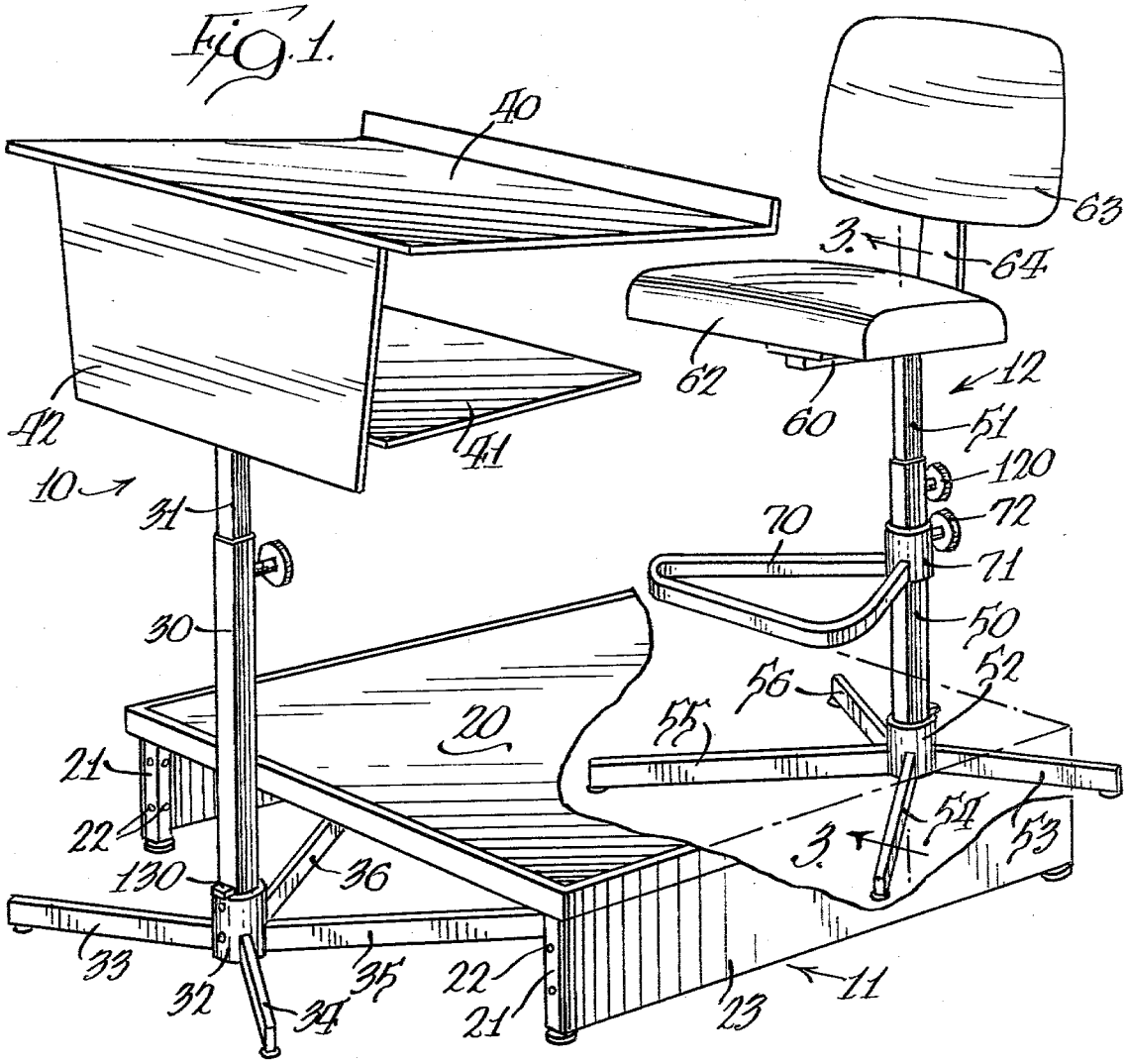
FIG. 1 is a perspective view, with parts broken away, showing the system components in operative relation.

The combination of structure usable by a choral or orchestral conductor or usable for other purposes is illustrated in FIG. 1, with the three basic components including a music stand, indicated generally at 10; a podium, indicated generally at 11; and a chair, indicated generally at 12.

With the components arranged as shown in FIG. 1, a conductor may stand on the podium 11 and have material supported on the music stand for use during conducting. Alternative to standing, the conductor may sit on the chair and still have the music stand closely adjacent to him. It will be obvious that each of the components may be used individually, with the music stand being generally usable as a lectern and the chair being available for any desired use.

The podium 11 has a generally rectangular flat standing area 20 provided by a top surface which may be carpeted and supported by a frame including a number of floor-engaging legs 21 positioned at each corner of the podium. Each leg is provided with fastener-receiving openings 22 whereby a releasable side panel 23 may be secured to a pair of legs to enclose a side of the podium beneath the standing area 20. If the podium is to be used by itself, there will be four of the side panels 23 attached to the legs 21 to have all four depending sides of the podium closed. When used with the music stand and chair, as shown in FIG. 1, two of the panels 23 have been removed to provide access beneath the podium for legs of the music stand and chair in order to bring the components into a closer relation.

The music stand 10 has a column defined by a hollow post 30 of generally square cross section which receives an adjustable tubular member 31 of generally square cross section therein with the lower end of the hollow post 30 being positioned in a generally cylindrical hollow base 32 having a series of generally horizontal legs 33, 34, 35 and 36 radiating outwardly from the base and with respect to an axis along which the column extends vertically upward from the base. The stand column supports a work surface 40, a shelf 41, and a front panel 42 by attachment thereof to an upper end of the tubular member 31 by means of structure, not shown. The work surface 40 and shelf 41 extend rearwardly from the stand column and as a result have the center of gravity rearwardly of the vertical axis of the column.

The chair 12 has a column with a hollow post 50 of generally square cross section receiving a generally square tubular member 51 with the lower end of the hollow post 50 being positionable in a cylindrical base 52. A series of generally horizontally-extending legs 53, 54, 55, and 56 radiate outwardly from the base and from a vertical axis coincident with the column. The upper end of the tubular member 51 has an offset arm 60 extending forwardly and mounting swivel structure 61 to which a chair seat 62 is connected. A chair back 63 is carried by an L-shaped member 64 which fastens to the underside of the chair seat 62. The forward offset of the chair seat causes the chair center of gravity to be forward of the vertical axis of the column.

A foot ring having a generally triangular member 70 is fastened to a tubular sleeve 71 for vertical adjustment along the hollow post 50 of the chair column for positioning at a desired level and for retention in a selected position by a threaded handle 72. This structure is shown in FIG. 3 and with there being a close fit of the sleeve 71 on the hollow post because of the square cross section thereof fitting within the tubular sleeve 71 even through a spaced relation is shown in FIG. 3.

Details of the chair structure are shown in FIGS. 2 to 6 with certain parts thereof being of the same structure as used in the music stand 10. With the chair and stand being formed of separable parts which may be packaged together for ease and economy in shipment, it is necessary to have a single predetermined assembly orientation of the parts because of the rearward extension of the work surface 40 and shelf 41 of the music stand and the forward extension of the chair seat 62. This is of particular importance because the generally horizontally-extending legs of the stand and chair are arranged to stabilize the chair and stand. More specifically, the legs 35 and 36 of the music stand extend rearwardly and are longer than the legs 33 and 34 as well as being at a smaller angle to each other whereby the legs will extend outwardly beneath the work surface and shelf and stabilize the music stand. There is minimal outward extension of the legs 33 and 34 because of their shorter length and their having a greater angle therebetween. In one specific embodiment, the rearwardly-extending legs 35 and 36 have an angle of approximately 70° therebetween and the legs 33 and 34 have an angle of approximately 120° therebetween with the remaining angles between legs being approximately 85°. For the chair 12, legs 54 and 55 extend forwardly and are longer than the legs 53 and 56. The relation of the angles between the legs is generally similar to that for the music stand, with the smallest angle being between the legs 54 and 55 and the largest angle being between the legs 53 and 56.

Figure 2:
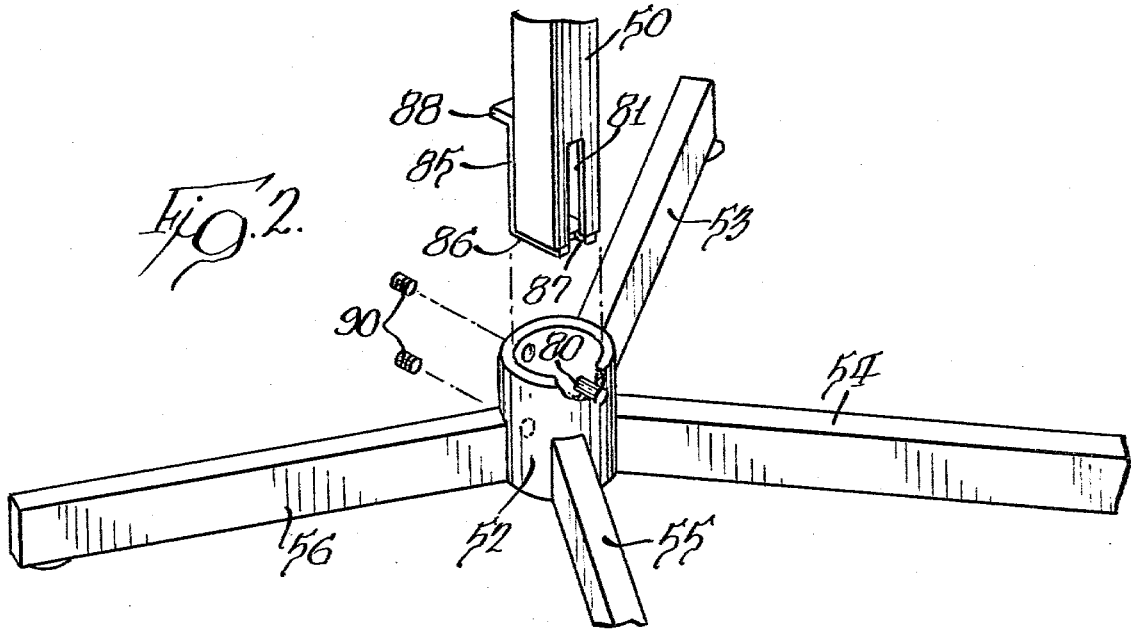
FIG. 2 is a fragmentary, exploded, perspective view showing the relation between the base of the frame structure and the lower end of a column.

In assembling either the music stand or chair and as shown for the chair in FIG. 2, the hollow post 50 is placed within the base 52 with interacting means assuring only a single rotative positioning of the hollow post in the base. This interacting means includes a pin 80 extending into the interior opening of the base and which coacts with an elongate slot 81 in a wall of the hollow post and opening to the lower end thereof to fit onto the pin 80. The movement of the hollow post into the base is limited by a flanged plate 85 affixed to a wall of the hollow post and having an inturned lower end 86 welded to the lower end of the hollow post 50 and having a notch 87 to avoid obstruction with the pin 80. A flange 88 of the plate rests on the upper end of the base 52 to limit the depth of insertion. The hollow post 50 is retained within the base by a pair of threaded members 90 which thread into the base and which tighten against the flange plate 85, as shown in the assembled position of FIG. 5.

Figures 3, 4, 5, 6:
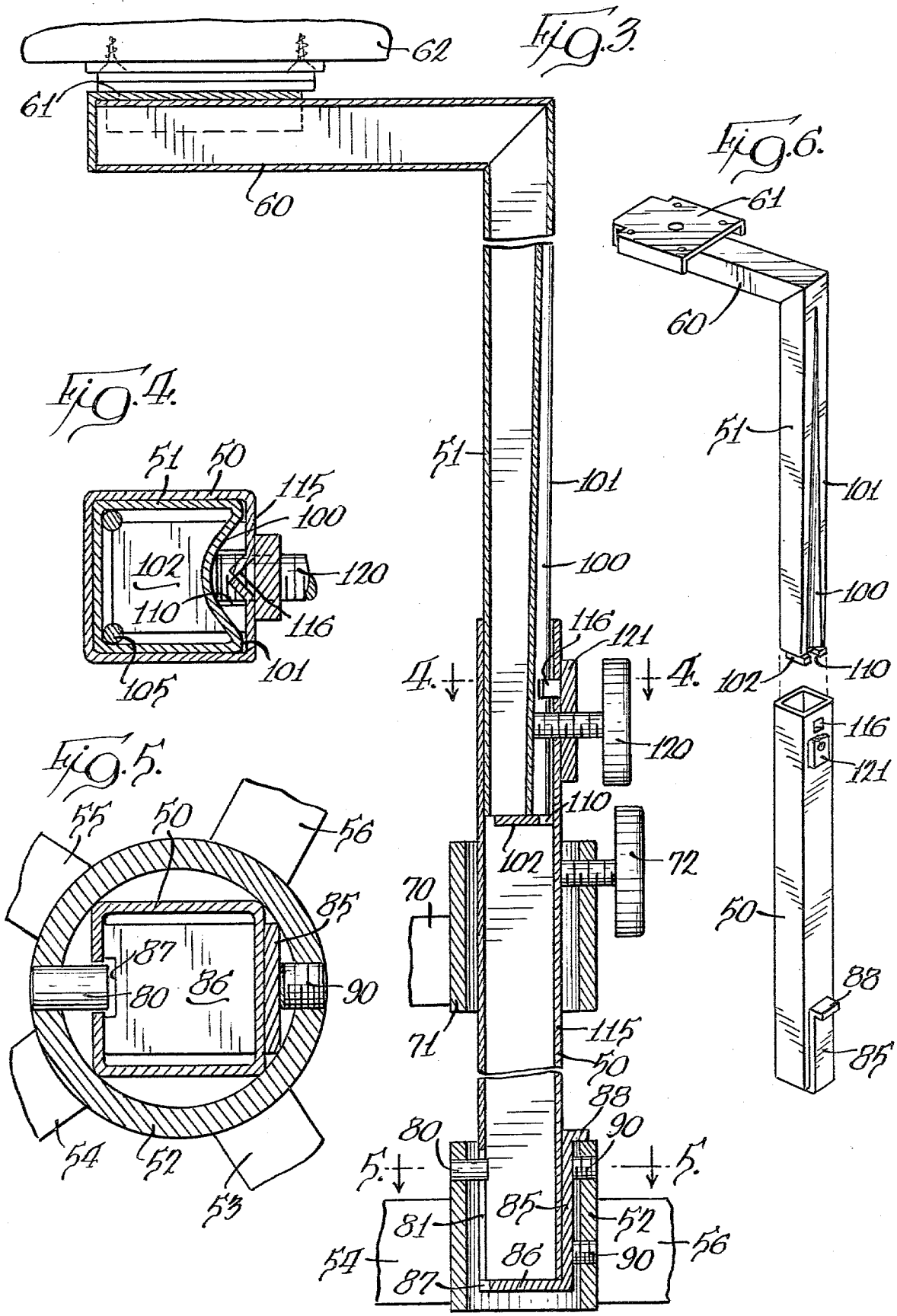
FIG. 3 is a fragmentary vertical section, on an enlarged scale, taken generally along the line 3—3 in FIG. 1.
FIG. 4 is a sectional view on a further enlarged scale, taken generally along the line 4—4 in FIG. 3.
FIG. 5 is a sectional view on an enlarged scale, taken generally along the line 5—5 in FIG. 3.
FIG. 6 is a perspective, exploded view of the components of the column of the frame structure.

The tubular member 51 is of generally square cross section and of a size to move within the hollow post 50 between an extended position, as shown in FIG. 3, and a fully lowered position substantially nested within the hollow post 50. A wall 101 of the tubular member 51 is formed with a sloped recess 100 increasing in depth towards the lower end of the tubular member which, as a result of the forming process, causes a slight downward and inward inclination of the wall 101. In order to have the tubular member 51 effectively of a full cross section within the hollow post 50, a plate 102 is secured to the lower end of the tubular member 51 by welds, as indicated at 105. As seen in FIGS. 3 and 6, the plate 102 extends outwardly beyond the lower end of the wall 101 to engage the interior of the hollow post 50 to provide for a nonrockable mounting of the tubular member within the hollow post.

The plate 102 has a notch 110 which coincides with the recess 100 and which, together, constitute structure on the tubular member forming part of the means interacting with the hollow post 50 to assure rotative positioning of the tubular member within the hollow post in only one position. A wall 115 of the hollow post 50 has a protrusion 116 formed by inwardly deformed sections of the wall material which permit insertion of the tubular member within the hollow post only when the recess 100 and notch 110 are aligned with the protrusion.

The column components are held in adjusted position relative to each other by a threaded handle 120 which threads into a plate 121 secured to the wall 115 of the hollow post and into engagement with the base of the recess 100. The inclination of the recess 100 assures that the tubular member cannot work downwardly during use of the chair.

With the construction disclosed herein, it is possible to place the legs of both the music stand and chair underneath the podium to enable a conductor to sit on the chair while using the music stand and, optionally, stand on the podium. Additionally, the foot ring 70 is usable at a desired height by positioning of the tubular sleeve 71 on the hollow post 50. The foot ring can be disposed above the podium or therebeneath if not to be used.

A significant feature is the fact that the chair is stabilized because of the irregular relation of the legs even though the chair seat is offset forwardly of the column axis. It is possible for a conductor to swivel to any position and still have the chair in good balance.

As stated previously, basic elements of the frame structure of the chair and music stand are the same, with the stand base 32 having the same structure as the chair base shown in FIG. 2. The hollow post 30 of the music stand has a flanged plate 130 of the same structure as the flanged plate 85 and performing the same functions. The tubular member 31 and the hollow post 30 have the same structure as the chair column with respect to the interacting means to assure one rotative alignment position.

I claim:

1. A chair frame structure comprising, a tubular base with a plurality of generally horizontal front and rear legs radiating from an axis centrally of said base and with said front legs being of a greater length than the rear legs, a column positionable in said base to extend upwardly along said axis having a hollow post of generally square cross section and an extendable tubular member positioned therein, means at the upper end of said tubular member for mounting a chair seat positioned forwardly of said axis to overlie said front legs, means carried on both said base and the lower end of the column to permit insertion of the column into the base in only one rotative position of the column including a fixed protruding pin on one of said base and column and an open-ended slot in a wall of the other of said base and column whereby the slot receives said pin upon insertion of a lower end of said hollow post into said base, and means permitting only one rotational orientation of the tubular member to the hollow post including a co-acting protrusion and a longitudinally-extending recess formed one in the tubular member and the other in the hollow post.

* * * * *